US007591097B2

(12) United States Patent
Alman et al.

(10) Patent No.: US 7,591,097 B2
(45) Date of Patent: Sep. 22, 2009

(54) CABINET STYLE JERSEY DISPLAY CASE

(75) Inventors: Norman H. Alman, Coral Springs, FL (US); Steve Block, Plantation, FL (US); Gerald Davis, Davie, FL (US)

(73) Assignee: Caseworks International, Inc., Tamarac, FL (US)

( * ) Notice: Subject to any disclaimer, the term of this patent is extended or adjusted under 35 U.S.C. 154(b) by 408 days.

(21) Appl. No.: 11/669,940

(22) Filed: Jan. 31, 2007

(65) Prior Publication Data

US 2008/0180003 A1 Jul. 31, 2008

(51) Int. Cl.
*A47G 1/06* (2006.01)

(52) U.S. Cl. ..... 40/800; 40/743; 40/722; 312/114

(58) Field of Classification Search ..... 40/711, 40/722, 743, 781, 800; 312/114, 245; 292/251.5, 292/259 R, 289, 68; 428/13; 223/85, 87
See application file for complete search history.

(56) References Cited

U.S. PATENT DOCUMENTS 4,304,447 A * 12/1981 Ellwood et al. ..... 312/204
5,218,774 A * 6/1993 Mullins ..... 40/722
5,244,131 A * 9/1993 Hollingsworth ..... 223/85
5,277,949 A * 1/1994 Green ..... 428/13
6,076,904 A * 6/2000 Shepherd et al. ..... 312/209
6,113,202 A * 9/2000 Germano ..... 312/245
6,158,633 A * 12/2000 Schwab ..... 223/85
6,158,828 A * 12/2000 Vacovsky et al. ..... 312/114
7,028,425 B2 * 4/2006 Lasher ..... 40/781
2006/0156605 A1 * 7/2006 Abrams ..... 40/781
2007/0137081 A1 * 6/2007 Chang ..... 40/781
2007/0251181 A1 * 11/2007 Dupont ..... 52/586.1
2008/0203869 A1 * 8/2008 Mallory ..... 312/245

* cited by examiner

*Primary Examiner*—Lesley D Morris
*Assistant Examiner*—Christopher E Veraa
(74) *Attorney, Agent, or Firm*—Jamin Rubenstein, P.L.; Jamin Douglas Rubenstein

(57) ABSTRACT

A wall-mounted cabinet style display case for displaying an athletic uniform jersey neatly inside. The back frame of the cabinet is fastened to the wall first. The back frame has a flat open pocket inside and the jersey is neatly displayed by hanging the jersey on uniform specific shaped hangers and folding the jersey inside and around the pocket for proper jersey display length. A completely removable front frame fastens to the back frame by first latching the top back of the front frame to the top of the back frame. The front frame is secured using metal plates on the back of the front frame and opposable magnets located on the back frame.

17 Claims, 7 Drawing Sheets

CABINET STYLE JERSEY DISPLAY CASE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCIAL LISTING," A TABLE, OR A COMPUTER PROGRAM LISTING APPENDIX SUBMITTED ON A COMPACT DISC

Not Applicable

SEQUENCE LISTINGS

Not Applicable

BACKGROUND OF THE INVENTION

1. Field of the Invention

The invention relates generally to the field of display cases for sports jerseys and memorabilia. The present invention is directed to a cabinet style display case which displays various athletic jerseys.

2 . Description of the Related Art Including Information Disclosed Under 37 CFR 1.97 and 1.98

Display cases are used to display various sports uniform jerseys and other memorabilia. Some display cases are cabinet style and are made by attaching a framed clear door to a plastic mold back frame using two hinges. Once mounted on the wall, the front door frame can then be opened to place, adjust, remove, and change jerseys or memorabilia which are inside. Some jersey displays are just like picture frames where the jersey is flattened between a clear piece of acrylic or glass and pressed against the back supporting panel. Sometimes the jersey is sewn into the back panel for securing it in place. Other display cases use two pieces of glass pressed together on both sides of the jersey in order to view the jersey from both sides.

Like many types of framed artwork and wall-mounted cabinetry, typical display cases are large and heavy because of their size, a previous necessity for displaying large jerseys neatly. When space on a wall is limited, or a person desires a smaller display case just because of size and weight, often the jersey is too large for the inside of the case and must be scrunched up at the bottom in order to completely fit inside. The result is poor presentation, increased wear and tear of the jersey, thereby decreasing preservation and combined overall value of the sports jersey and display case.

Given their weight, display case cabinets are often difficult to mount on the wall and have posed many problems for people during installation. The typical two-hinged door system also makes installation difficult because sometimes the door may swing open during mounting, thereby compromising balance. Often people drop and break display cases during installation because of their weight, unbalanced nature when the framed door is ajar, or a combination of both.

Typically, sports jerseys hang on a hanger which hooks to the top inside part of the display case. Because the fabric and cut of hockey, basketball, football, soccer and baseball jerseys vary, a common one size fits all hanger fails to accentuate the specific variations. Some hangers have been made in an attempt to display the jersey in a three dimensional way, but are not designed to accentuate the fabric and cut of the varying sports jerseys.

When a collector owns several jerseys from different sports, and wants to periodically change the jersey to display, the person typically takes the jersey out of the case, pulls it off the hanger, and places a different jersey on the same shaped hanger. Jerseys displayed in picture frames, although they can be removed and changed, the frame must first be taken off the wall and second the backing on the frame must be removed to access the jersey for adjustment or removal.

BRIEF SUMMARY OF THE INVENTION

The present invention is a cabinet style display case which displays real size sports jerseys. Although the present invention is smaller in size than prior art jersey display cases, it provides a better quality of presentation and better preservation of the condition of the jersey by use of an open flat pocket inside the cabinet which the jersey folds neatly around.

The present invention uses a latching and magnetic fastening system for the clear front frame which makes the entire display case easy to install, safe, and user friendly. Because the present invention is made of two separate parts, a back frame including a safety ridge on top and two magnets on each front side, and a front frame including a latch on the top back and two magnets on each back side, persons installing the cabinet can mount the back frame on the wall first, and then fasten the front frame on the back frame. After installation, it is an object of the invention for users to be able to easily, quickly, and safely remove the front frame in order to place, adjust, remove, and change jerseys and other memorabilia.

The present invention uses specially designed hanger molds which hang on a hook molded inside the top of the back frame. One variable use hanger mold provides for the proper hanging of football, hockey, baseball or soccer jerseys. There are two rectangular cut-outs in the variable hanger mold, each cut-out attaches on the hook molded inside the back frame depending on which way the hanger mold is used. A second hanger mold is specially designed for basketball jerseys and has a rectangular cut-out which attaches on the hook molded inside the back frame.

It is an object of the present invention to reduce manufacturing costs by using less material, reduce shipping costs by having a display case which weighs less, and increase environmental friendliness by an overall reduction in material and energy consumption expended during manufacturing and delivery to consumers.

DETAILED DESCRIPTION OF THE INVENTION

Figure 1:
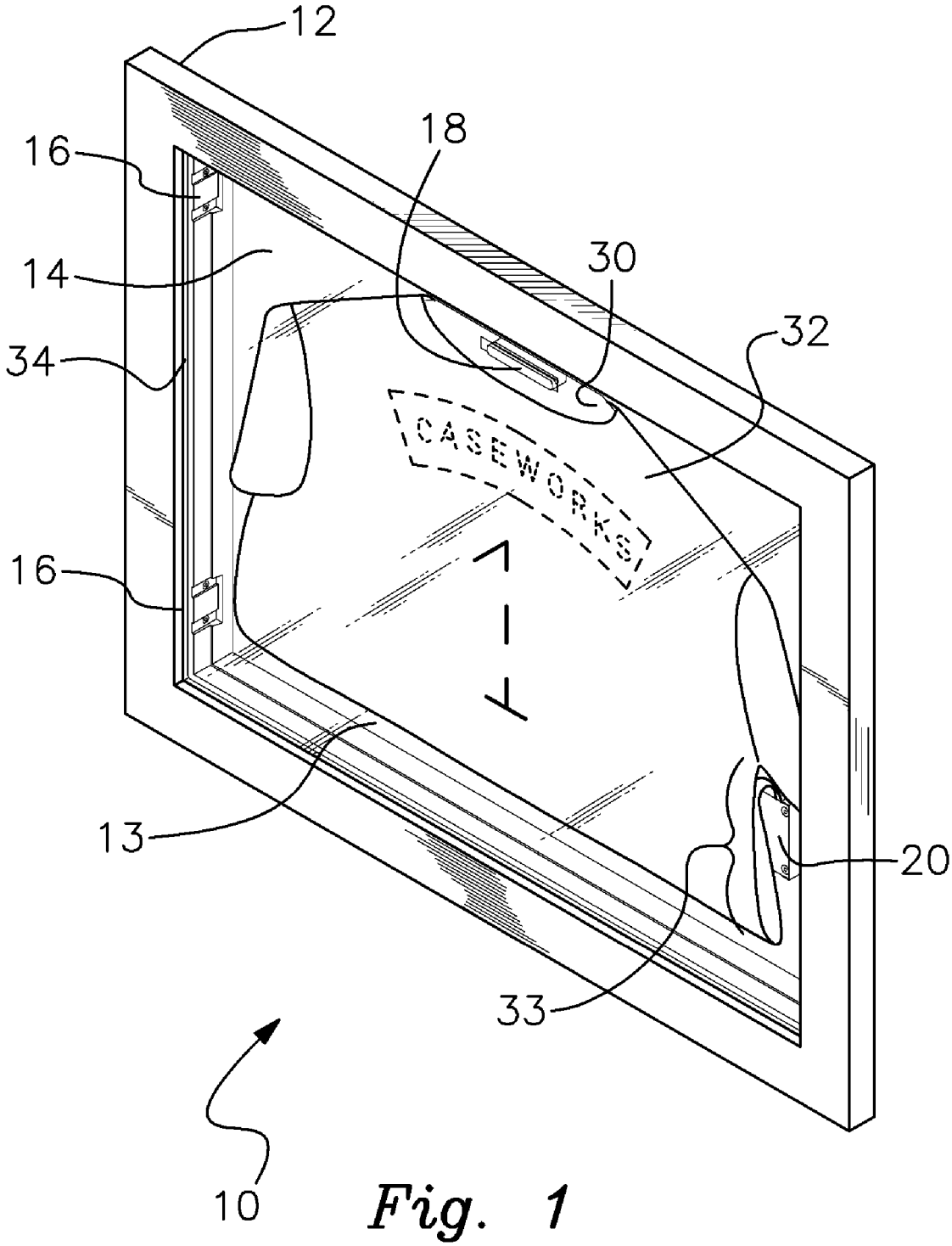
FIG. 1 is a perspective view of a cabinet style jersey display case displaying a baseball jersey in accordance with the present invention.

Referring to FIG. 1, there is shown a cabinet style display case 10 for use in displaying a jersey 32 in accordance with the present invention. The display case 10 includes a front frame 12 with a clear faced cover 13, a back frame 14, a cavity 34 between the front frame 12 and back frame 14 and a support member 30 for hanging the jersey 32 inside the display case 10 in a way which accentuates the fabric and cut of the jersey. The support member 30 has a rectangular cut-out at the top of the hanger 31 (shown in FIG. 10) which is hanging on the permanently molded hook 18 inside the top central portion of the back frame 14. Specifically, the support member 30 is a baseball jersey hanger which accentuates the fabric and cut of a baseball jersey 32 with sloping shoulders. The bottom of the jersey 32 is folded 33 neatly up and around into the inside of the open pocket 20 inside the back frame 14.

Figure 2:
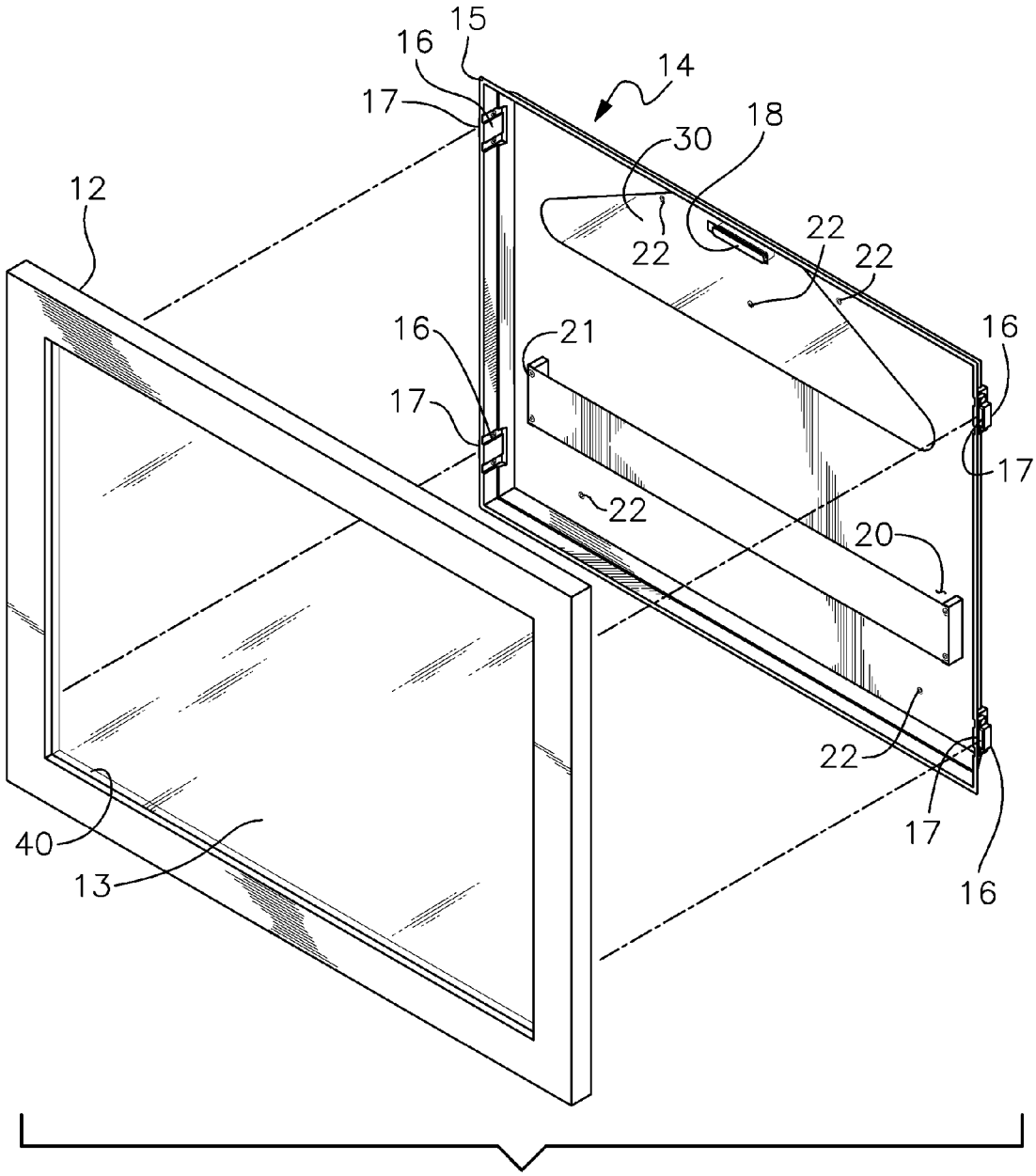
FIG. 2 is an exploded view of a display case with a baseball jersey hanger, a front frame, a back frame, and four locations where the magnets and the back of the front frame come together.

FIG. 2 is the front frame 12 and the back frame 14 separated apart to show the locations of the magnets 17 in the two magnetic housings 16 on each side of the back frame 14. The clear faced cover 13 is identified within the front frame 12 and is made of either acrylic or glass. There is a ridge 15 around the entire outside portion of the back frame 14 which fits flush with a recess 40 around the entire inside portion of the back of the front frame 12 when secured together. Also, the five pre-drilled holes 22 in the back frame 14 are used for wall-mounting with the appropriate hardware depending on the type of wall composition.

The back frame 14 is mounted on the wall first before attaching the front frame 12. The pre-drilled holes 22 are intentionally located in the back frame 14 where they can not be seen when any one of the three support members 28, 30, 30*a* (shown in FIG. 9, FIG. 10, and FIG. 11) is used with the corresponding baseball, soccer, basketball, football, and hockey jersey 32 in the present invention. More specifically, three of the five pre-drilled holes 22 are located behind the support member 30 towards the top of the back frame 14 and two of the pre-drilled holes 22 are located just below the open pocket 20. When any of the above referenced full-size jerseys is folded correctly up, around, and inside the open pocket 20, the jersey will hang over neatly, and cover the two pre-drilled holes 22 on the bottom.

The open pocket 20 is shown at the bottom of the back frame 14 with one of the four attachments 21 which secure the open pocket 20 permanently inside the back frame 14. The support member 30 is used with baseball or soccer jerseys and is banging on the permanently molded hook 18 located on the inside top central portion of the back frame 14. The support member 30 has a rectangular cut-out 31 (shown in FIG. 10) specifically designed to fit and hang the support member 30 onto the permanently molded hook 18.

Figures 3, 4, 5:
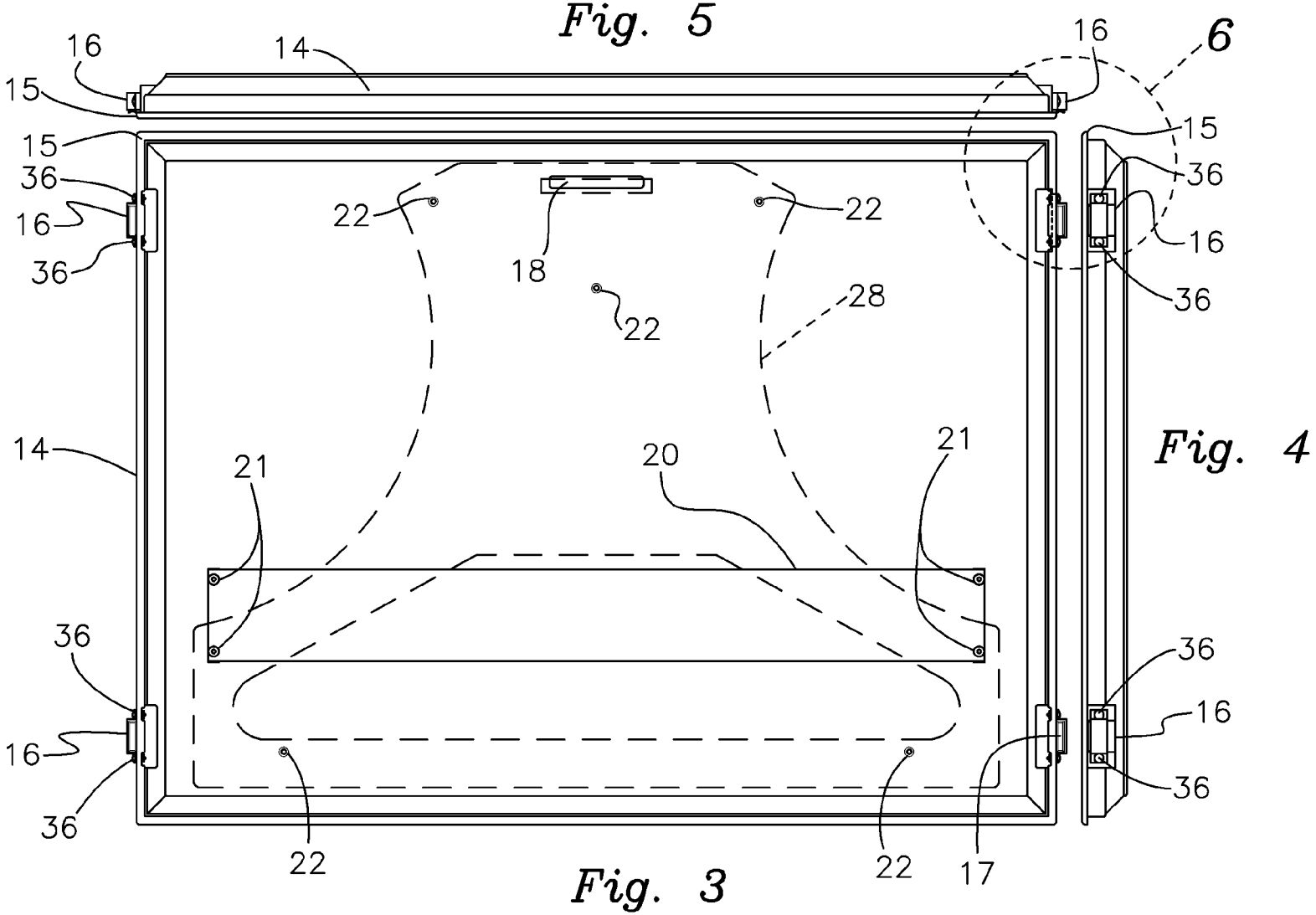
FIG. 3 is the front view of the back frame with a basketball hanger inside.
FIG. 4 is the side view of the back frame.
FIG. 5 is the top view of the back frame.

FIG. 3 is the front view of the back frame 14. Along the top side of the back frame 14 is a ridge 15. The four magnetic housings 16 are shown, as is the location of a magnet 17. The magnetic housing is shown 16 to attach permanently to the side of the back frame 14 using two rivets 36. The open pocket 20 and the four attachments 21 where the open pocket 20 is secured permanently to the back frame 14 are shown. The support member 28 specially designed to be used with basketball jerseys is shown hanging on the permanently molded hook 18 using the rectangular cut-out at the top of the support member 28. As in FIG. 2, FIG. 3 illustrates the locations of the pre-drilled holes 22 used for wall mounting and are intentionally located in the back frame 14 where they can not be seen when support member 28 is used with the corresponding basketball jersey in the present invention.

FIG. 4 is a side view of the back frame 14. At the top is a ridge 15. Two magnetic housings 16 are shown, as are the corresponding locations of the rivets 36 which secure each housing 16 to the back frame 14.

FIG. 5 is a top view of the back frame 14 and a ridge 15. Two magnetic housings 16 are shown, one on each side of the back frame 14.

Figure 6:
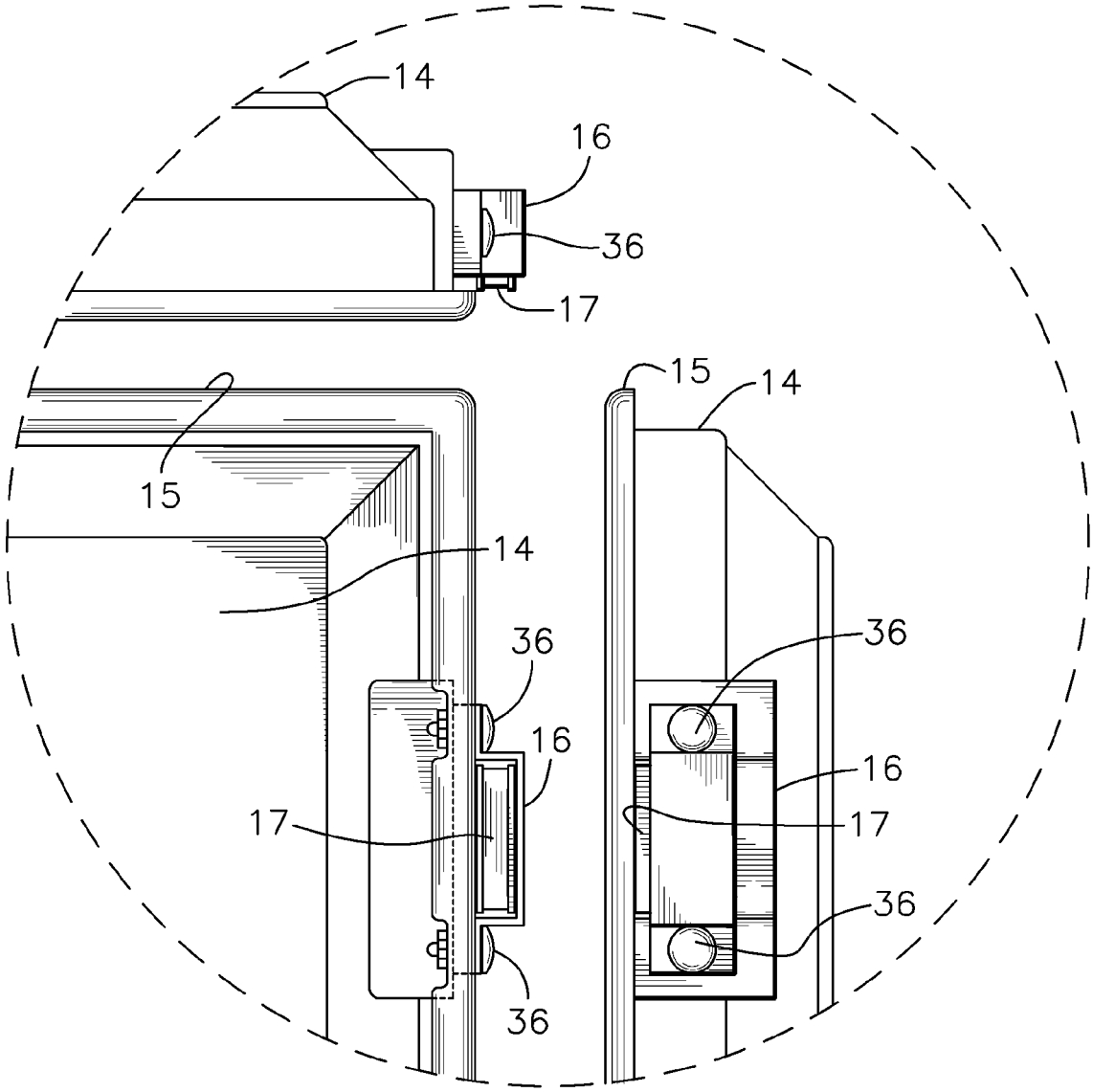
FIG. 6 is an exploded front view, side view, and top view of a corner of the back frame.

FIG. 6 is an exploded view of parts of FIG. 3, FIG. 4, and FIG. 5. More specifically, one exploded magnetic housing 16 is shown from a front view, side view, and top view. Also shown are the locations of the rivets 36 which secure the magnetic housing 16 onto the back frame 14. The magnet 17 is shown in the exploded front view and is secured permanently inside the magnetic housing 16. A ridge 15 is along the outside portion of the back frame 14.

Figure 7:
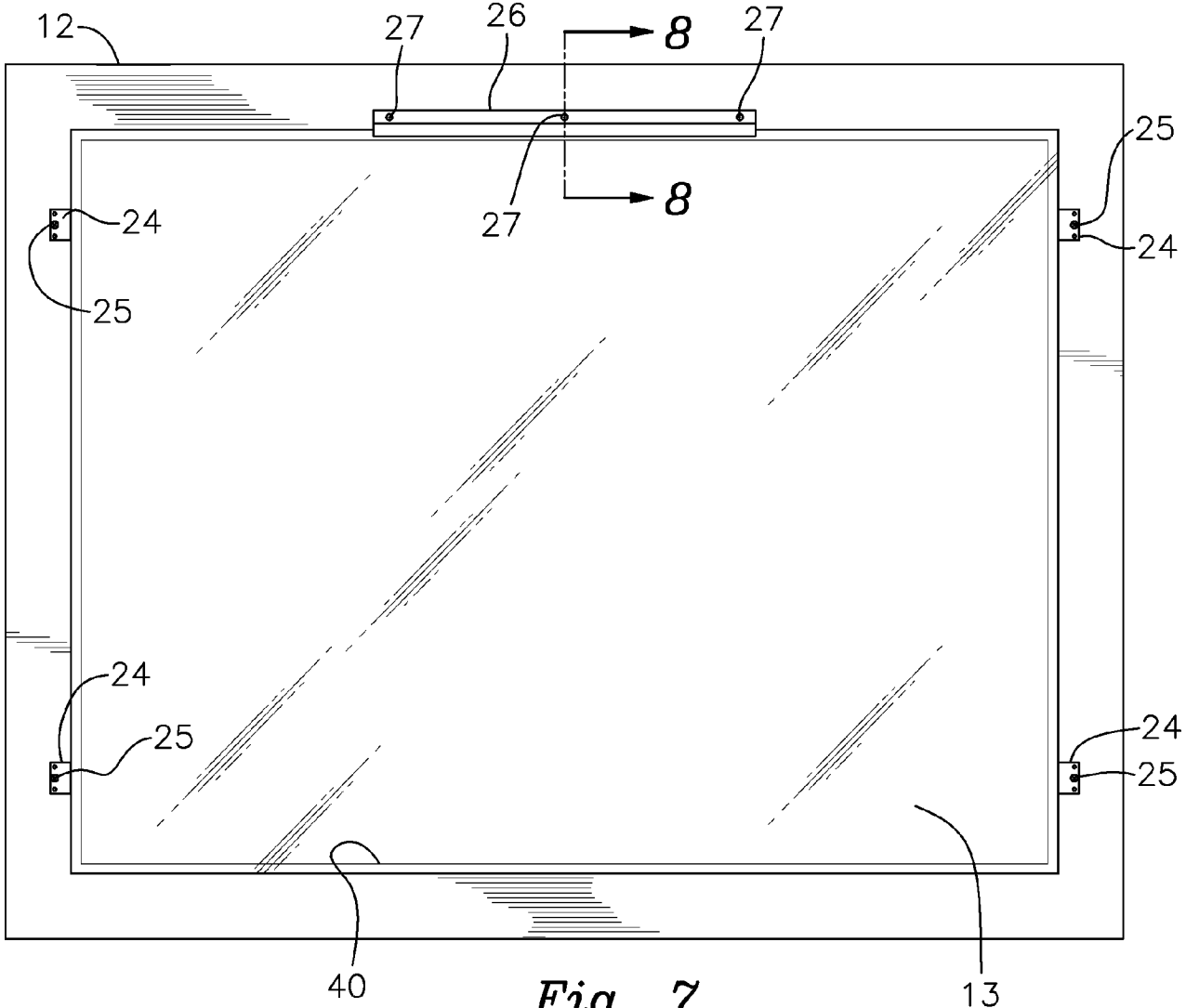
FIG. 7 is the back view of the front frame.

FIG. 7 is the back of the front frame 12. There is a recess 40 around the entire inside portion of the back of the front frame 12 into which the ridge around the entire outside portion of the back frame fits flush with (shown in FIG. 12) when secured together. Four metal plates 24 are shown, as are the locations of the screws 25 which secure the metal plates 24 to the back of the front frame 12. One screw 25 secures each metal plate 24 to the back of the front frame 12 and there are two dimples on the back of each metal plate 24 which fit into two opposable recess dimples in the back of the front frame 12 to prevent the metal plates 24 from rotating around the screw 25. At the top of the front frame 12 is the acrylic z-bar 26 which is secured to the back of the front frame 12 using three screws 27 which are spaced equally apart. The clear faced cover 13 which is made of acrylic or glass, is shown within the front frame 12.

Figure 8:
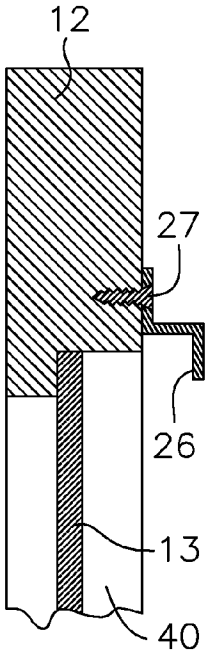
FIG. 8 is an exploded cross-sectional view of the top of the front frame showing an acrylic z-bar.

FIG. 8 is an exploded cross-sectional view of the top of the front frame 12. There is a recess 40 which the ridge on the back frame (shown in FIG. 12) fits flush with when secured together with the front frame 12. The acrylic z-bar 26 is shown secured to the front frame 12 using screws 27. Also shown is the clear faced cover 13 within the front frame 12.

Figure 9:
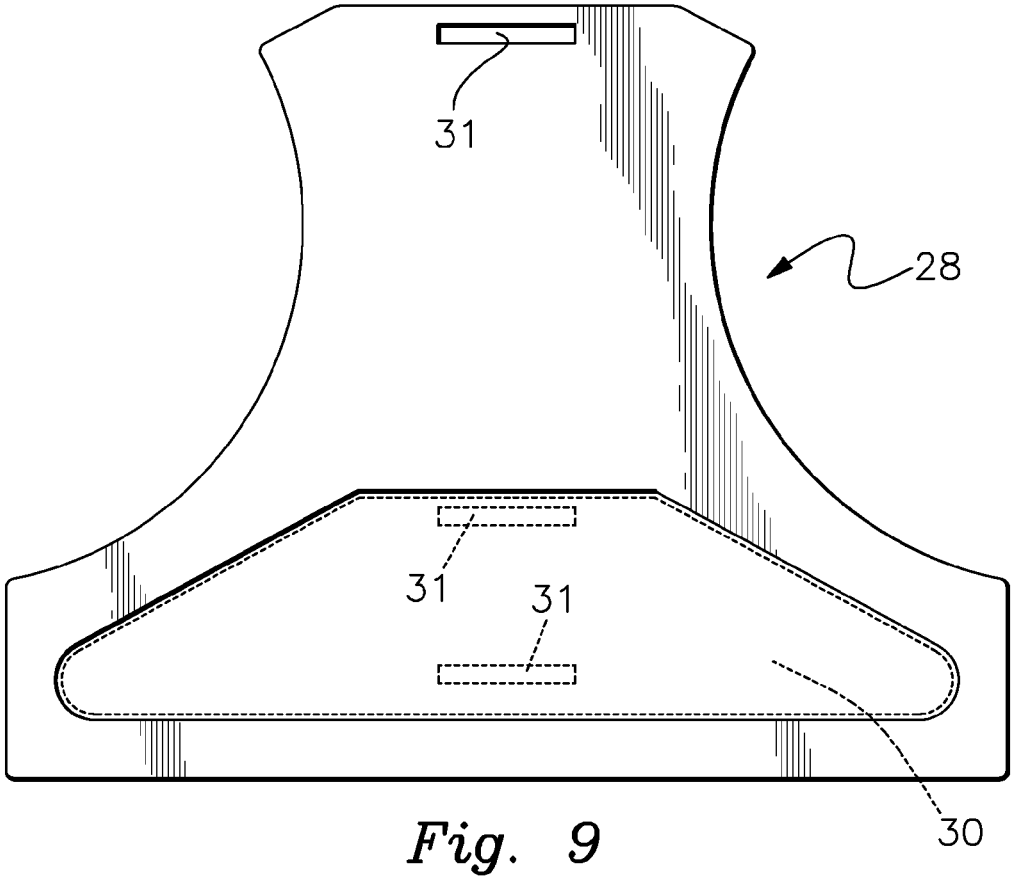
FIG. 9 is a basketball jersey hanger.
Figure 10:
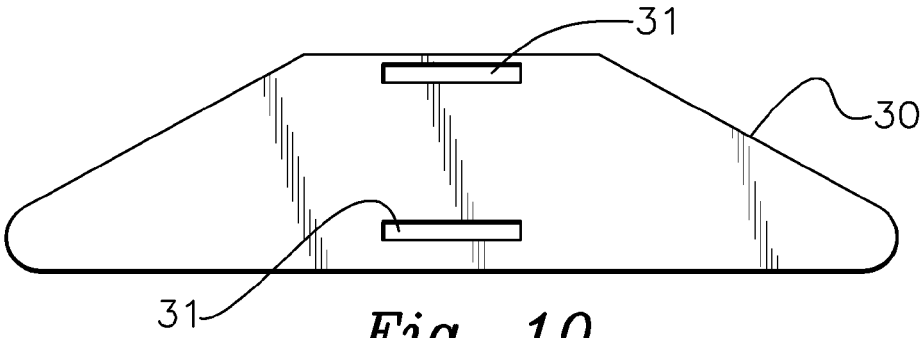
FIG. 10 is the baseball or soccer jersey hanger.
Figure 11:
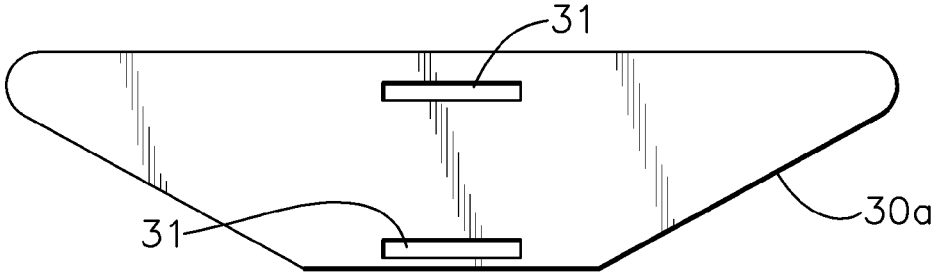
FIG. 11 is a football or hockey jersey hanger.

FIG. 9, FIG. 10, and FIG. 11 are the three support members 28, 30, 30*a* which are specially designed to be used with a specific sports jersey. Support member 28 shown in FIG. 9 is intentionally designed so the manufacturer can make use of all the acrylic mold cut, thereby conserving materials and energy during the manufacturing process. More specifically, FIG. 9 shows where support members 30 and 30*a* are cut out of the bottom of support member 28, thereby reducing waste and creating one new support member which can be used in two alternative ways as shown in FIG. 10 and FIG. 11.

FIG. 9 is a hanger mold which is shaped like a stretched out basketball jersey to accentuate the fabric and cut of a basketball jersey. Intentionally made of a clear acrylic, it is hard to see when displaying a jersey inside the display case. At the top of the support member 28 is a rectangular cut-out 31 which is specifically sized to fit and hang on the permanently molded hook 18 (shown in FIG. 3).

FIG. 10 is the variable jersey hanger mold which is designed to be used with a baseball or soccer jersey so that the shoulders slope down on both sides to accentuate the fabric and cut of each jersey. Intentionally made of a clear acrylic, it is hard to see when displaying a jersey inside the display case. At the top of the support member 30 is a rectangular cut-out 31 which is specifically sized to fit and hang on the permanently molded hook 18 (shown in FIG. 3).

FIG. 11 is the variable jersey hanger mold which is designed to be used with a football or hockey jersey so that the shoulders extend parallel to the top of the back frame to accentuate the fabric and cut of each jersey. Intentionally made of a clear acrylic, it is hard to see when displaying a jersey inside the display case. At the top of the support member 30*a* is a rectangular cut-out 31 which is specifically sized to fit and hang on the permanently molded hook 18 (shown in FIG. 3).

Figure 12:
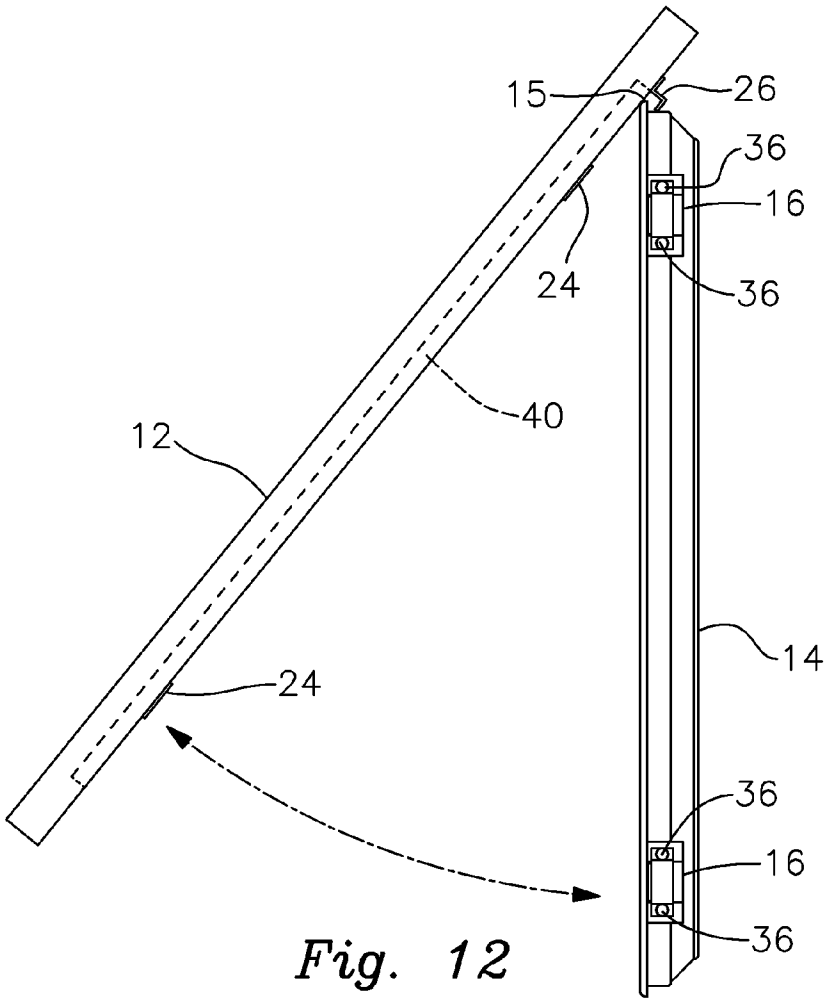
FIG. 12 is the side view of the display case showing the z-bar on the top back portion of the front frame latching on to a ridge on the top of the back frame.

Referring to FIG. 12, there is shown a side view of the front frame 12 latching onto the ridge 15 on the top of the back frame 14 using the acrylic z-bar 26. The acrylic z-bar 26 latches to the ridge 15 to secure and guide the front frame 12 before closing. The front frame 12 and back frame 14 secure together using the four magnetic housings 16 with four magnets and the four metal plates 24. There is a recess 40 shown on the back of the front frame 12 into which the back frame 14 fits in flush with when secured together.

Figure 13:
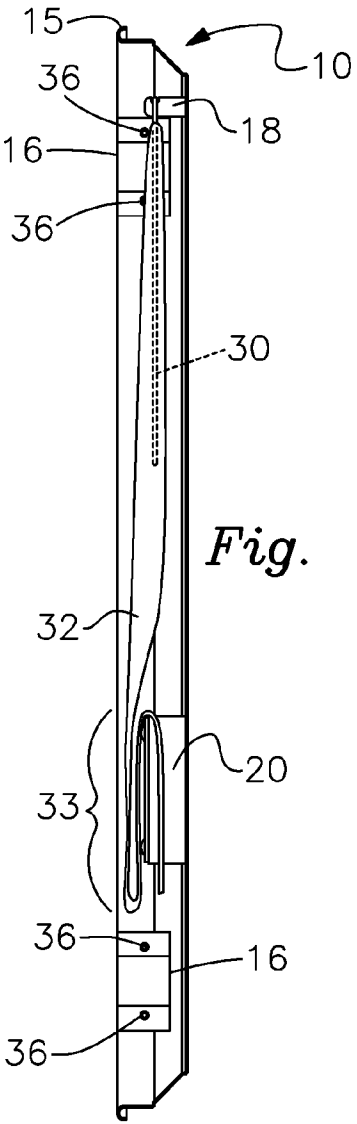
FIG. 13 is a partial cross section view of the jersey folded in between the front frame and back frame in an open pocket in the back frame.

FIG. 13 is a partial cross section view of a jersey 32 folded 33 neatly up and around into the inside of the open pocket 20. The entire display case 10 is shown closed with a jersey 32 inside. The magnetic housings 16 and corresponding rivets 36 are also shown. The support member 30 is shown hanging on the permanently molded hook 18.

A cabinet style display case for various athletic jerseys and memorabilia has been shown which serves the purposes sought herein. Modifications, variations, other uses, and applications of the present invention will become apparent to those skilled in the art after considering the specifications and the drawings which disclose the present invention. Modifications, variations, other uses, and applications which are not outside the scope and spirit of the present invention are deemed covered by the present invention which is limited only by the following claims.

Having disclosed the invention, what is claimed follows:

1. A cabinet style display case for displaying an item, the display case comprising:

(a) a back frame having a plurality of pre-drilled holes for securing the back frame to a wall using fastening hardware, a plurality of permanent housings for magnets attached to the back frame, a plurality of magnets inserted in the permanent housings, a ridge across a top outside portion of the back frame, an open pocket affixed permanently inside a lower portion of the back frame, a hook molded permanently on an inside top central portion of the back frame; and (b) a front frame having a clear faced cover affixed permanently within the front frame, a plurality of metal plates affixed permanently to a back of the front frame in the opposable locations of the magnets, a z-bar affixed permanently on a top central back portion of the front frame for latching the front frame to the back frame; and (c) a support member adapted to be attached to the hook molded permanently on the inside top central portion of the back frame used to hang the item within the display case.

2. A display case as defined in claim 1, wherein the back frame is made of a thermo-formable plastic.

3. A display case as defined in claim 1, wherein the pre-drilled holes are located in the back frame hidden from view when the item is inside the display case.

4. A display case as defined in claim 1, wherein there are four permanent housings for magnets, each housing is affixed permanently on a lateral side of the back frame using two rivets, one housing is near a top of the back frame on a left lateral side, one housing is near a bottom of the back frame on the left lateral side, one housing is near the top of the back frame on a right lateral side, one housing is near the bottom of the back frame on the right lateral side, one magnet is permanently located inside each of the four permanent housings.

5. A display case as defined in claim 1, wherein the open pocket is used to fold extra jersey length up and around an inside portion of the open pocket for neat presentation.

6. A display case as defined in claim 1, wherein the front frame is made of a custom cut frame composition of wood, metal, or a composite material.

7. A display case as defined in claim 1, wherein there are four metal plates, each metal plate is affixed permanently to the back of the front frame using one screw, each metal plate is located at an opposable location to each magnet inside the permanent housings on the back frame.

8. A display case as defined in claim 1, wherein the z-bar is made of acrylic and is affixed permanently on the top central back portion of the front frame using three screws spaced equally apart.

9. A display case as defined in claim 1, wherein the clear faced cover is permanently affixed within the front frame and is made of plastic or glass.

10. A display case as defined in claim 1, wherein the support member is made of a clear acrylic sheet designed to be hard to see when used with an appropriate jersey in the display case.

11. A display case as defined in claim 1, wherein the item is one of a basketball, baseball, football, soccer or hockey jersey.

12. A display case as defined in claim 1, wherein the support member is shaped like a triangular garment hanger, to accentuate a two dimensional natural form of the jersey, one rectangular cut-out is located at a bottom central portion of the support, member, one rectangular cut-out is located at a top central portion of the support member, each rectangular cut-out attaches on to the permanently molded hook inside the top central portion of the back frame, the support member is designed to be used right side up with a baseball or soccer jersey with sloped-down shoulders, or in the alternative flipped upside down to be used with a hockey or football jersey with shoulders parallel to the top of the display case.

13. A display case as defined in claim 1, wherein the support member is shaped like a stretched out basketball jersey, to accentuate a two dimensional natural form of a basketball jersey, one rectangular cut-out is located at the top central portion of the support member, the rectangular cut-out attaches on to the permanently molded hook inside the top central portion of the back frame.

14. A method of hanging an item within a cabinet style display case, the method comprising:

(a) providing a back frame having a plurality of pre-drilled holes for securing the back frame to a wall;

(b) providing a plurality of permanent housings containing magnets;

(c) providing a ridge across a top outside portion of the back frame for guiding and securing a front frame onto the back frame when latching the front frame onto the back frame;

(d) providing an open pocket inside a lower portion of the back frame for folding extra length of the item neatly inside the display case;

(e) providing a hook molded permanently on an inside top central portion of the back frame for hanging a support member;

(f) providing a clear faced cover within the front frame so that the item can be viewed when hanging inside the display case;

(g) providing a plurality of metal plates affixed permanently to a back of the front frame for attracting the magnets attached to the back frame;

(h) providing an acrylic z-bar affixed permanently on a top central back portion of the front frame for latching the top central back portion of the front frame onto the ridge on the top outside portion of the back frame; and (i) providing the support member having a rectangular cut-out at a top central portion of the support member for attaching the support member to the permanently molded hook on the inside top central portion of the back frame.

15. The method according to claim 14 wherein the support member is provided with a shape like a basketball jersey so that the cut and fabric of the basketball jersey are accentuated when hanging on the support member inside the display case.

16. The method according to claim 14 wherein the support member is provided with a shape like a triangular garment hanger so that the cut and fabric of a baseball or soccer jersey are accentuated when hanging on the support member inside the display case.

17. The method according to claim 14 wherein the support member is provided with a shape like an upside down triangular garment hanger so that the cut and fabric of a hockey jersey or football jersey are accentuated when hanging on the support member inside the display case.

* * * * *